US005149381A

United States Patent [19]

Grewe et al.

[11] Patent Number: 5,149,381

[45] Date of Patent: Sep. 22, 1992

[54] METHOD OF MAKING A COMPOSITE POWDER COMPRISING NANOCRYSTALLITES EMBEDDED IN AN AMORPHOUS PHASE

[75] Inventors: Hans Grewe, Grefrath-Vinkrath; Wolfgang Schlump, Essen, both of Fed. Rep. of Germany

[73] Assignee: Fried.Krupp GmbH, Essen, Fed. Rep. of Germany

[21] Appl. No.: 279,646

[22] Filed: Dec. 5, 1988

[30] Foreign Application Priority Data

Dec. 4, 1987 [DE] Fed. Rep. of Germany ..... 3741119

[51] Int. Cl.[5] ..... C22C 1/00

[52] U.S. Cl. ..... 148/513; 75/255; 148/403; 419/12; 419/14; 419/30; 419/33; 501/94

[58] Field of Search ..... 148/11.5 P, 11.5 Q, 148/403; 75/251; 419/12-14, 30, 33

[56] References Cited

U.S. PATENT DOCUMENTS

| | | | |
|---|---|---|---|
| 4,557,766 | 12/1985 | Tenhover et al. | 148/11.5 P |
| 4,557,893 | 12/1985 | Jatkar et al. | 419/33 |
| 4,605,631 | 8/1986 | Rossi | 501/1 |
| 4,710,236 | 12/1987 | Schultz | 148/11.5 P |
| 4,735,770 | 4/1988 | Schultz et al. | 148/11.5 P |
| 4,750,932 | 6/1988 | Parent et al. | 419/33 |
| 4,761,263 | 8/1988 | Politis et al. | 419/33 |
| 4,797,166 | 1/1989 | Von Allmen et al. | 148/403 |
| 4,836,849 | 6/1989 | Svedberg et al. | 419/23 |
| 4,891,059 | 1/1990 | Diamond et al. | 75/5 A |
| 4,909,840 | 3/1990 | Schlump | 75/232 |

FOREIGN PATENT DOCUMENTS

| | | |
|---|---|---|
| 152957 | 8/1985 | European Pat. Off. . |
| 213410 | 3/1987 | European Pat. Off. . |
| 219582 | 4/1987 | European Pat. Off. . |
| 232772 | 9/1987 | European Pat. Off. . |
| 288785 | 11/1988 | European Pat. Off. . |
| 2412022 | 9/1975 | Fed. Rep. of Germany . |
| 2830010 | 2/1979 | Fed. Rep. of Germany . |
| 3601794 | 7/1987 | Fed. Rep. of Germany . |
| 87-04425 | 7/1987 | PCT Int'l Appl. . |
| 1298944 | 12/1972 | United Kingdom . |
| 2156854 | 10/1985 | United Kingdom . |

OTHER PUBLICATIONS

F. Petzoldt et al., Materials Letters, "Study of the Mechanism of Amorphization by Mechanical Alloying", vol. 5, Nos. 7, 8, pp. 280-284 (Jul. 1987).

H. Gleiter et al., Zeitscrift Fur Metallkunde, "Nanokristalline Strukturen ein Weg zu neuen Materialien?" Band 75, No. 4, pp. 263-267 (Apr. 1984).

R. Birringer et al., Physics Letters "Nano crystalline Materials an Approach to a novel solid structure with Gas-Like Disorder?", vol. 102A, No. 8, pp. 365-369 (Jun. 1984).

*Primary Examiner*—Upendra Roy

*Attorney, Agent, or Firm*—Spencer & Frank

[57] ABSTRACT

A process for the production of a powder having a nanocrystalline structure from powders of at least two materials of the groups including metals, metallic compounds, and ceramic materials, in a composition which tends to develop an amorphous phase. The starting powders are subjected to high stresses of at least 12 G in a neutral or reducing atmosphere at about 20° C. until there are no crystallites larger than about 10 nm.

19 Claims, 5 Drawing Sheets

METHOD OF MAKING A COMPOSITE POWDER COMPRISING NANOCRYSTALLITES EMBEDDED IN AN AMORPHOUS PHASE

FIELD OF THE INVENTION

This invention relates to the production of powders having a nanocrystalline structure for use in making articles of metal, ceramic, or other materials.

TECHNOLOGY REVIEW

The production of materials having nanocrystalline structures can be effected by compacting crystallites having a diameter of a few nanometers into a solid body under high pressure (several MPa). In principle, all methods permitting the production of sufficiently small crystallites with "clean" surfaces are suitable for the production of nanocrystalline materials.

A basic distinction can be made between chemical and physical methods in the production of small crystallites.

The chemical processes relate primarily to the thermal decomposition of solid or gaseous compounds and to the reduction of solid substances and metal ions in solutions. A significant drawback of many chemical manufacturing processes is that the exposed crystallite surfaces are covered with foreign atoms and molecules.

The known physical methods used most frequently for the production of small crystals include atomization in an electric arc and vaporization in an inert atmosphere or in a vacuum with subsequent isoentropic expansion. These methods have the advantage that the surface of the resulting individual crystal powder particle can be kept practically free of impurities and that the powder can be compacted directly into molded articles having a nanocrystalline structure. However since only about 0.1 g oxygen is required for the production of a monolayer of oxygen on the exposed surface of 1 g iron crystallites having a diameter of 5 nm, and this is about $10^{10}$ times more oxygen than is typically contained in the remaining gas of a vacuum chamber, it does not take long until relatively large quantities of undesirable oxygen nitrogen and/or water molecules have been deposited on the large specific surface area of the iron particles in the nanometer range. These molecules then can form oxide, nitride and/or oxynitride coatings on the particle surface. Here again, the avoidance of impurities on the surfaces is the greatest problem. The production of materials having a nanocrystalline structure and a clean surface is thus very expensive.

SUMMARY OF THE INVENTION

It is therefore an object of the present invention to overcome this drawback in the production of nanocrystalline materials by producing powder particles of a size in a range of a few μm with a nanocrystalline structure whose exterior surfaces are relatively inert to the components of the surrounding medium. These clean particles can thus be processed without problems under the usual conditions of powder metallurgical manufacture into molded bodies having a nanocrystalline structure.

Surprisingly, this problem can be solved by the present invention for powder mixtures whose compositions tend to form amorphous phases under grinding conditions. According to the invention, a powder mixture adapted to form an amorphous phase and having grain sizes between 2 and 250 μm is mechanically stressed at a stress of at least 12 G for a period of time in a neutral or reducing atmosphere at room temperature. (In this specification, 1 G is the acceleration due to normal earth gravity). The period of time necessary for the production of the powder according to the invention can be determined from transmission electron microscope (TEM) photographs. When these photographs show only crystallites that are less than about 10 nm in size, the particles have attained the properties which the present invention requires for the powder particles. During the grinding process, heating must be avoided since otherwise the metastable amorphous phase is not retained. On the other hand, the grinding process should not take so long that the nanocrystalline structure is destroyed.

DETAILED DESCRIPTION OF THE INVENTION

The powder used as starting material must be of a composition which will develop at least one amorphous phase under conditions of grinding at a stress of at least 12 G. The temperature of the powder during grinding is not critical, and may vary from about 50° C. to 200° C.

Figure 3:
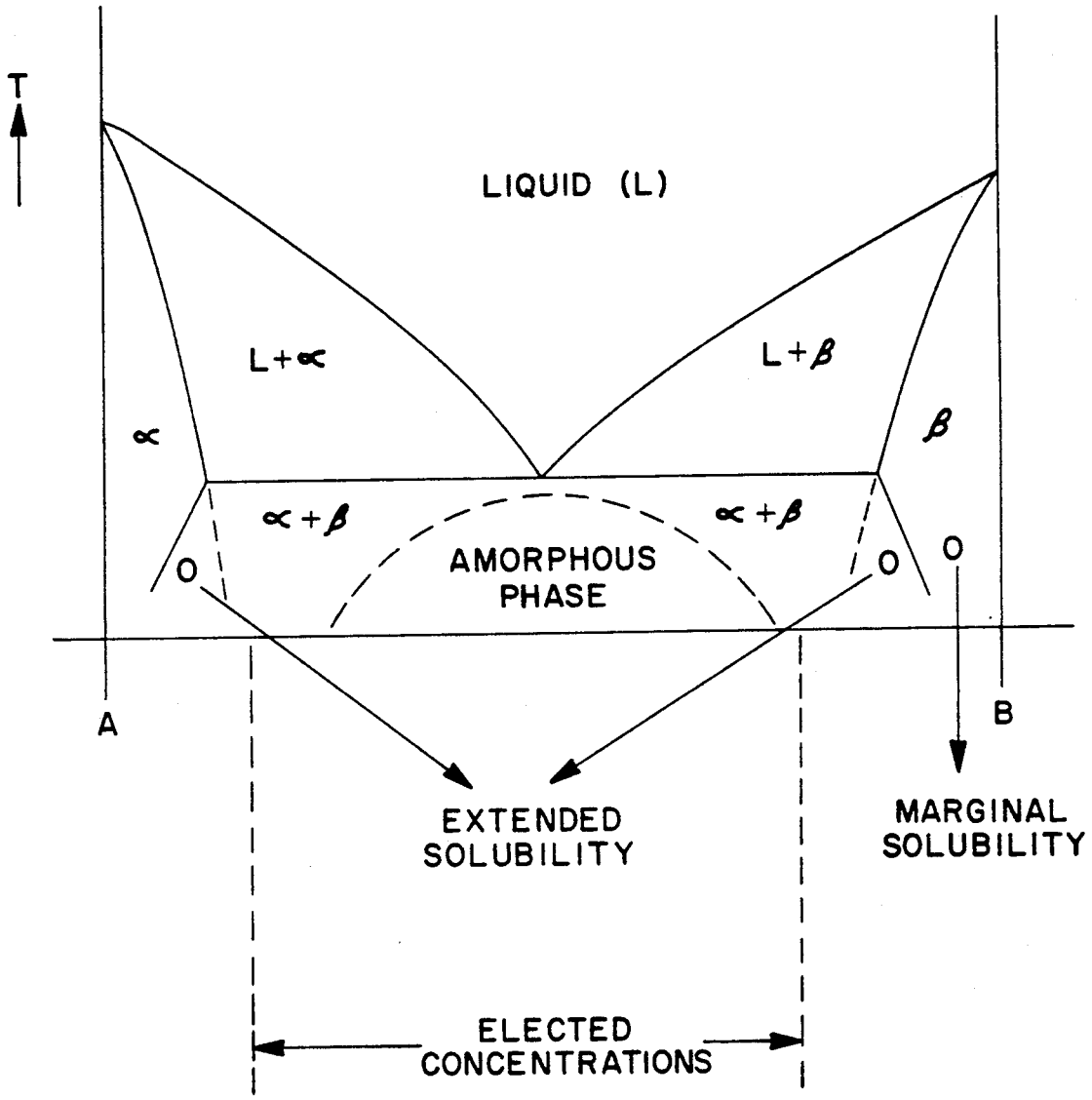
FIG. 3 illustrates the boundaries of the amorphous phase.

A composition of powder to be used as a starting material in which a multiphase region is present between the amorphous and the crystalline phases is particularly advantageous. The elemental ratios making up such compositions can be determined from the appropriate metastable phase diagram. A phase diagram including a multi-phase region between an amorphous phase and a crystalline phase is illustrated in FIG. 3. Such multi-phase regions may be present at temperatures from about 300° C. to about 1,000° C., see FIG. 3 as illustrated by FIG. 3. The alloying system of the components exhibits a distinct eutectic or eutectoid reaction and the mixing ratio is selected so that it lies outside of the marginal solubilities. As used herein "marginal solubility" refers to the solubility given by the phase diagram (thermodynamic equilibrium).

The powder particles produced according to the invention can be processed further without special precautionary measures under ambient conditions. The material compacted from these powder particles according to the usual methods, below the recrystallization temperature of the powder, exhibits a nanocrystalline structure.

The process of the invention is suitable for powders of metallic materials, of materials having metallic properties, such as intermetallics, for example carbides and nitrides, and of ceramic materials including a plurality of components. Of particular advantage are binary or multi-component substances composed of at least one element of the group including Y, Ti, Zr, Hf, Mo, Nb, Ta, W and at least one of the elements of the group including V, Cr, Mn, Fe, Co, Ni, Cu, Pd without or with the addition of accompanying elements such as Si, Ge, B and/or oxides, nitrides, borides, carbides and their mixed crystals, either in pure form or as corresponding pre-alloys of these groups The extreme degrees of deformation of the particles, necessary to practice the invention, can be achieved advantageously by high-energy grinding, e.g. impact grinding, particularly in an attrition mill.

Surprisingly the specific surface of the powder particles produced according to the invention does not increase with the duration of grinding but remains the same or decreases slightly. We theorize this indicates that the surface is gas-tight and no internal surfaces in the region of the nanocrystalline structure are accessible to the gases of the surrounding atmosphere. The surfaces in the nanocrystalline range remain clean, and their chemical resistance is surprisingly high presumably because the small crystallites are embedded in an amorphous phase. The purity of the material therefore remains high even after exposure to ambient conditions. However, this invention is not limited by this theory or any other theory.

The subject matter of the invention is described below with reference to a titanium-nickel powder mixture as the starting material.

The powder mixture was composed of 70 weight percent of a commercially available Ti powder (FSSS 28 μm) and 30 weight percent of a commercially available nickel powder (FSSS 4.7 μm). The abbreviation FSSS means: "Fisher-Sub-Sieve-Sizer". The powders were initially mixed for one hour in a turbulence mixer and then ground in a horizontally placed attrition mill. The weight of the powder charge was 1000 g. Grinding was effected with the use of nickel roller bearing balls having a diameter of about 6 mm. The mass ratio of nickel to powder was 20:1. Grinding lasted 90 hours with a stirring arm revolving at 200 rpm. By using larger grinding assemblies (10 kg charges), grinding times can be reduced significantly.

Figure 1:
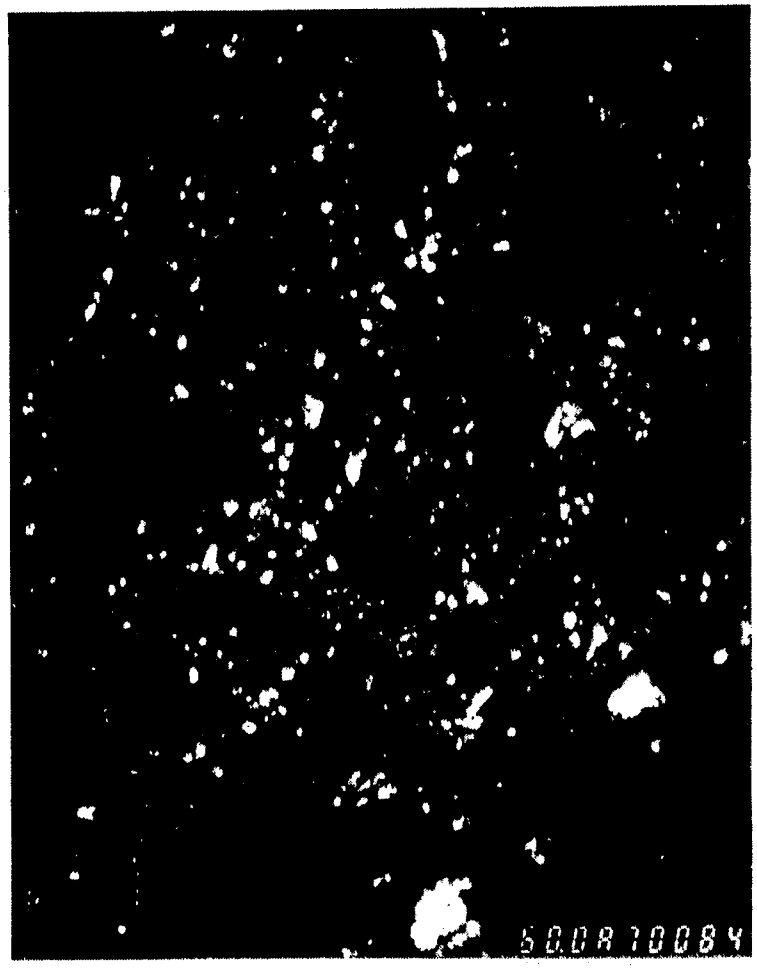
FIG. 1 is a transmission electron micrograph of a titanium-nickel powder after 40 hours of grinding.
Figure 2A:
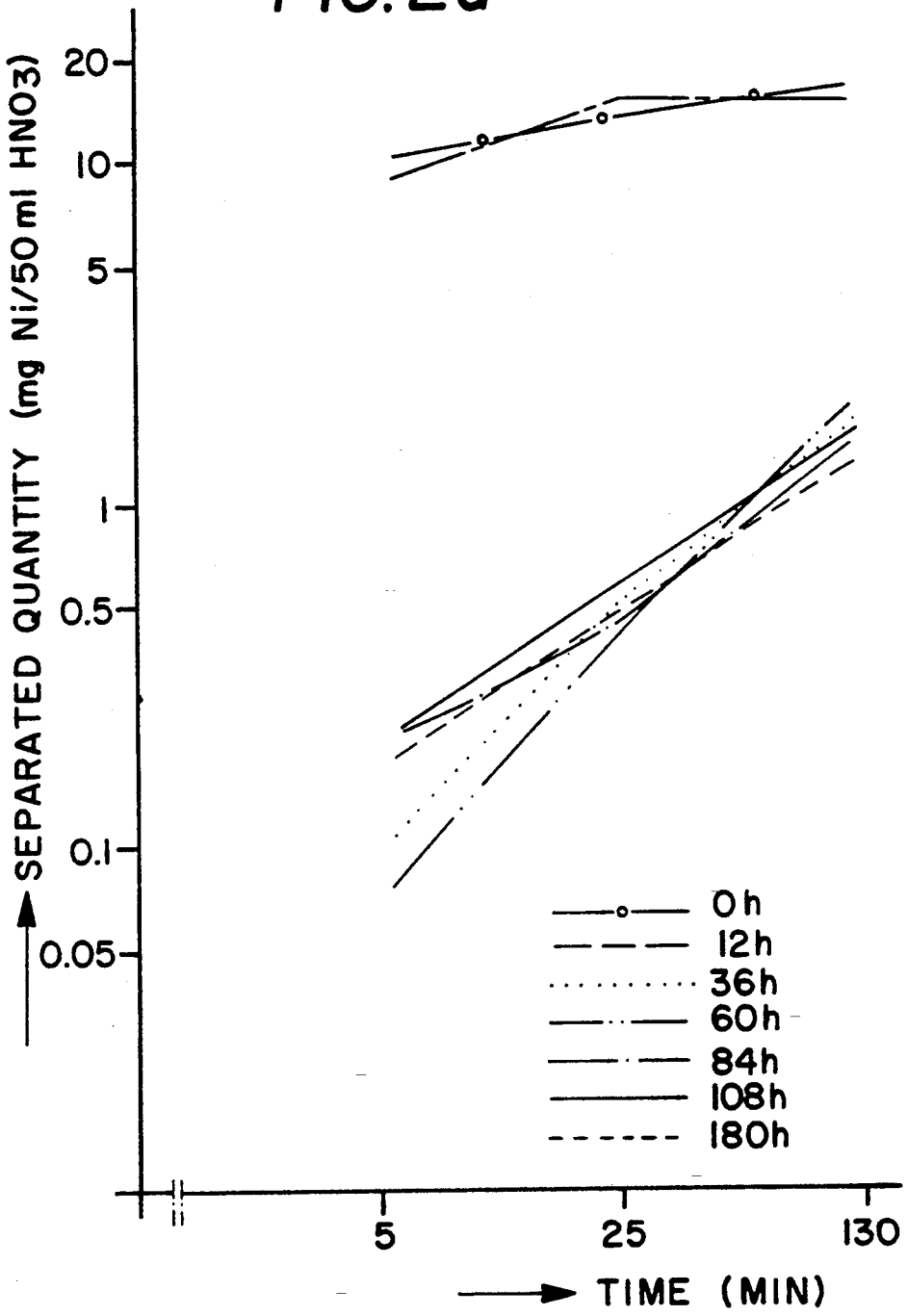
FIGS. 2*a*–2*c* are graphs showing the chemical resistance of powders treated according to the invention for various lengths of time.
Figure 2B:
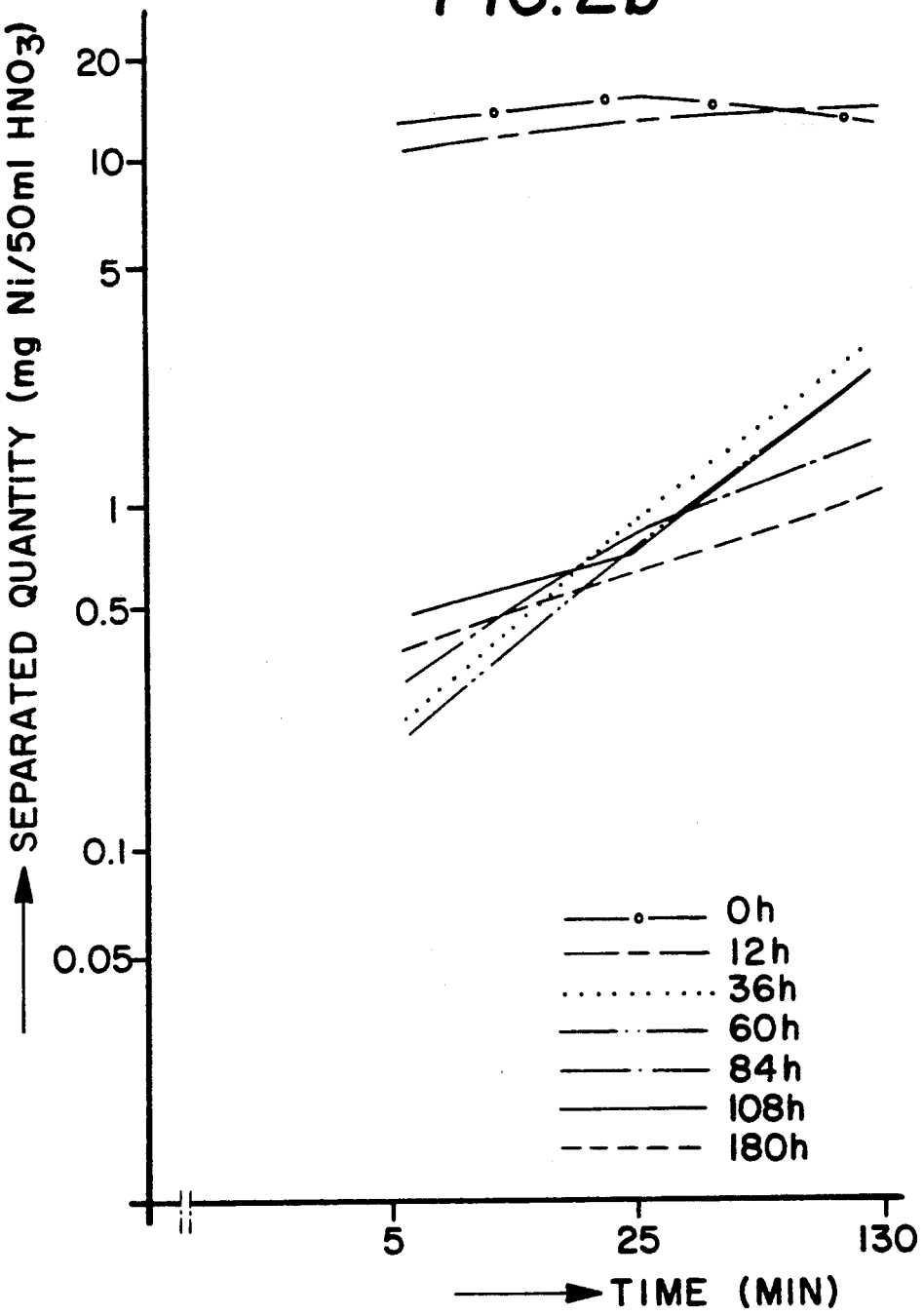
Figure 2C:
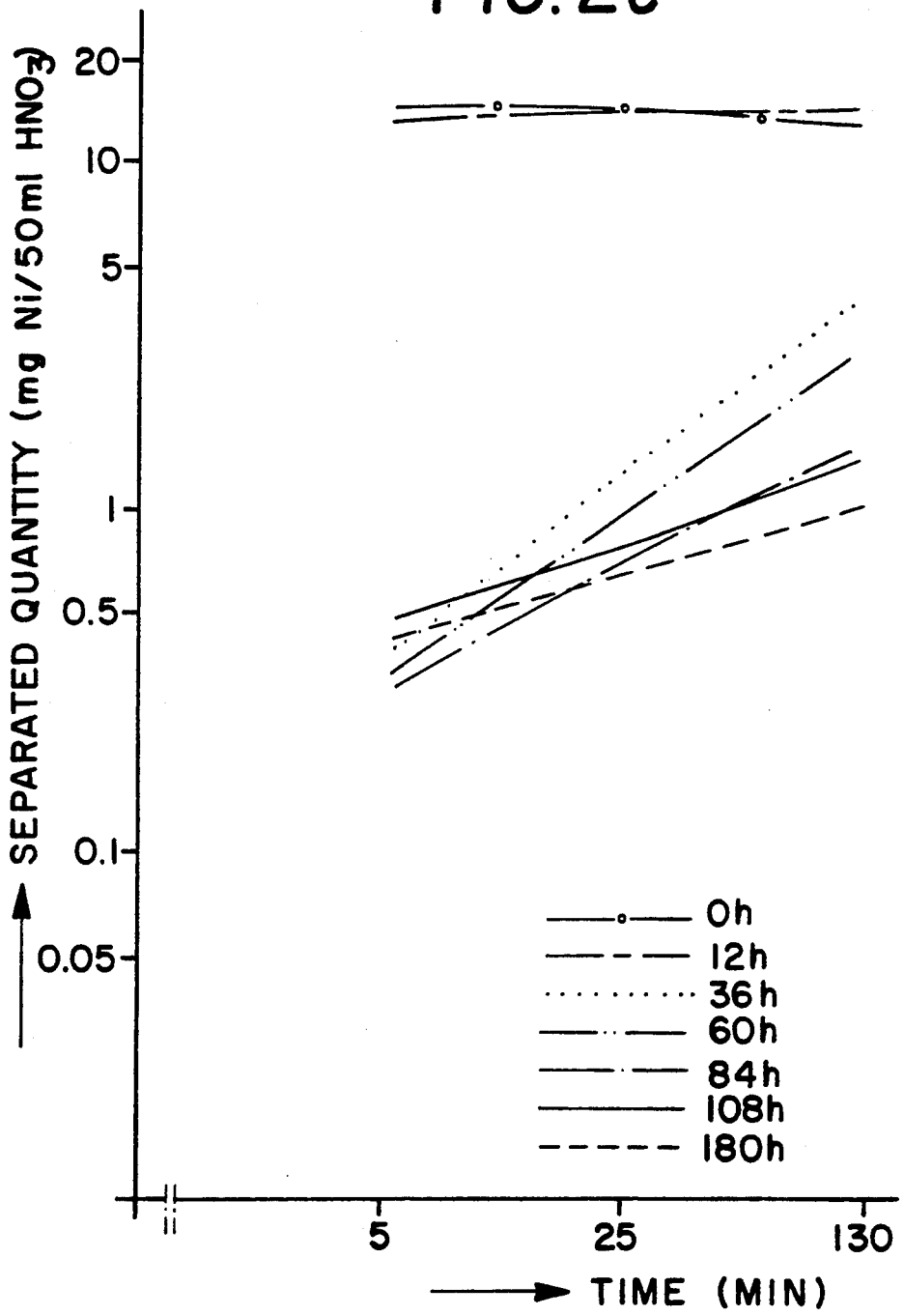

FIG. 1 shows TEM photograph with a magnification of 200,000:1 of TiNi powders produced according to the invention with a mass percentage of 70/30. The photograph clearly show the crystallites embedded in an amorphous phase. FIG. 1 shows the result after 40 hours of grinding. Although the amorphous phase already exists at this point, some of the crystallites are still bigger than 10 nm. After 90 hours of grinding there are only crystallites less than 10 nm in size.

The specific surface area of a Ti Ni powder having a mass percentage of 70/30, measured according to the BET (Brunauer, Emmet & Teller) method, showed the following values: 0.152 $m^2/g$ (0 hours), 0.140 $m^2/g$ (90 hours), 0.137 $m^2/g$ (180 hours). Thus, the specific surface area surprisingly decreases slightly with the grinding time.

Graphs *2a* to *2c* show the results of tests in which 50 mg of the TiNi powder having a mass percentage of 70/30 were introduced into a 1N $HNO_3$ solution at 30° C. (FIG. *2a*), at 40° C. (FIG. *2b*) and at 50° C. (FIG. *2c*). The amount of Ni extracted by the acid as a function of the time for powders obtained after different grinding times is graphed. In each case, the powders were initially mixed for 1 hour in a turbulence mixer and were then ground in an attrition mill for 0 to 180 hours It can be seen clearly that with longer grinding times the quantity of Ni which can be extracted becomes significantly smaller. After 36 hours of grinding, the treated (ground) powder exhibits substantially higher chemical resistance than the untreated starting powder mixture.

The present disclosure relates to the subject matter disclosed in Federal Republic of Germany application, Serial Number P 37 41 119.5, filed Dec. 4th, 1987, the entire disclosure of which is incorporated herein by reference.

It will be understood that the above description of the present invention is susceptible to various modifications, changes, and adaptations, and the same are intended to be comprehended within the meaning and range of equivalents of the appended claims.

What is claimed is:

1. A process for producing a powder, comprising the steps of:

mixing powders of at least two different ceramics, in a ratio adapted to form at least one amorphous phase; and subjecting the mixed powders to mechanical stresses of at least 12 G in a neutral or reducing atmosphere at about 20° C. until there are no crystallites larger than about 10 nm as determined by transmission electron microscopy, to produce powder particles having unreactive exterior surfaces and comprising at least one amorphous phase in which said crystallites not larger than about 10 nm are embedded.

2. A process as defined in claim 1 wherein said at least two materials comprise a first material selected from the group of elements consisting of Y, Ti, Zr, Hr, Nb, Mo, Ta and W, and a second material selected from the group of elements consisting of V, Cr, Mn, Fe, Co, Ni, Cu and Pd.

3. A process as defined in claim 1, wherein the composition of the powder is selected so that a multi-phase region exists between an amorphous phase and a crystalline phase.

4. A process as defined in claim 1, wherein the mechanical stress is effected by cold deformation.

5. A process as defined in claim 1, wherein the mechanical stress is effected by grinding.

6. A process as defined in claim 5, wherein the grinding is effected by an attrition mill.

7. A process for producing a powder, comprising the steps of:

mixing, in a ratio adapted to form at least one amorphous phase, a first powder essentially composed of at least one element from the group consisting of Y, Ti, Zr, Hf, Nb, Mo, Ta and W in elemental form or as a compound also containing at least one element selected from the group consisting of Si, Ge, B, O, N and C, with a second powder essentially composed of at least one element from the group consisting of V, Cr, Mn, Fe, Co, Ni, Cu and Pd in elemental form or as a compound also containing at least one element selected from the group consisting of Si, Ge, B, O, N and C; and subjecting the mixed powders to mechanical stresses of at least 12 G until there are no crystallites larger than about 10 nm as determined by transmission electron microscopy, to produce powder particles having unreactive exterior surfaces and comprising at least one amorphous phase in which said crystallites not larger than about 10 nm are embedded.

8. A process as defined in claim 7, wherein the composition of the powder is selected so that a multi-phase region exists between an amorphous phase and a crystalline phase.

9. A process as defined in claim 7, wherein the mechanical stress is effected by cold deformation.

10. A process as defined in claim 7, wherein the mechanical stress is effected by grinding.

11. A process as defined in claim 10, wherein the grinding is effected by an attrition mill.

12. A process for producing a powder, comprising the steps of:

mixing powders of at least two different metals, in a ratio adapted to form at least one amorphous phase; and subjecting the mixed powders to mechanical stresses of at least 12 G in a neutral or reducing atmosphere at about 20° C. until there are no crystallites larger than about 10 nm as determined by transmission electron microscopy, to produce powder particles having unreactive exterior surfaces and comprising at least one amorphous phase in which said crystallites not larger than about 10 nm are embedded.

13. A process as defined in claim 12, wherein the composition of the powder is selected so that a multiphase region exists between an amorphous phase and a crystalline phase.

14. A process as defined in claim 12, wherein the mechanical stress is effected by cold deformation.

15. A process as defined in claim 12, wherein the mechanical stress is effected by grinding.

16. A process for producing a powder, comprising the steps of:

mixing powders of at least two different compounds having metallic characteristics in a ratio adapted to form at least one amorphous phase; and subjecting the mixed powders to mechanical stresses of at least 12 G in a neutral or reducing atmosphere at about 20° C. until there are no crystallites larger than about 10 nm as determined by transmission electron microscopy, to produce powder particles having unreactive exterior surfaces and comprising at least one amorphous phase in which said crystallites not larger than about 10 nm are embedded.

17. A process as defined in claim 13, wherein the composition of the powder is selected so that a multiphase region exists between an amorphous phase and a crystalline phase.

18. A process as defined in claim 13, wherein the mechanical stress is effected by cold deformation.

19. A process as defined in claim 13, wherein the mechanical stress is effected by grinding.

* * * * *